US010781005B2

(12) United States Patent
Luo

(10) Patent No.: US 10,781,005 B2
(45) Date of Patent: Sep. 22, 2020

(54) WINDING MACHINE

(71) Applicant: HANGZHOU YOUNGSUN INTELLIGENT EQUIPMENT CO., LTD., Xihu Hangzhou, Zhejiang (CN)

(72) Inventor: Bangyi Luo, Zhejiang (CN)

(73) Assignee: HANGZHOU YOUNGSUN INTELLIGENT EQUIPMENT CO., LTD., Hangzhou, Zhejiang Province (CN)

( * ) Notice: Subject to any disclaimer, the term of this patent is extended or adjusted under 35 U.S.C. 154(b) by 606 days.

(21) Appl. No.: 14/899,413

(22) PCT Filed: Aug. 22, 2013

(86) PCT No.: PCT/CN2013/082058
§ 371 (c)(1),
(2) Date: Dec. 17, 2015

(87) PCT Pub. No.: WO2014/205908
PCT Pub. Date: Dec. 31, 2014

(65) Prior Publication Data

US 2016/0137322 A1 May 19, 2016

(30) Foreign Application Priority Data

Jun. 27, 2013 (CN) ..... 2013 1 0266617
Jun. 27, 2013 (CN) ..... 2013 2 0378884 U

(51) Int. Cl.
*B65B 11/04* (2006.01)
*B65B 65/00* (2006.01)

(52) U.S. Cl.
CPC ..... *B65B 11/045* (2013.01); *B65B 65/00* (2013.01)

(58) Field of Classification Search
CPC ..... B65B 11/045; B65B 11/04; B65B 65/00
(Continued)

(56) References Cited

U.S. PATENT DOCUMENTS 4,248,031 A * 2/1981 Del Pozo, Jr. ..... B65B 11/045 53/556
4,718,219 A * 1/1988 Schmitz ..... B65B 11/045 53/211

(Continued)

FOREIGN PATENT DOCUMENTS

CN 101503118 A * 8/2009
CN 101503118 A 8/2009

(Continued)

*Primary Examiner* — Thanh K Truong
*Assistant Examiner* — Katie L Gerth
(74) *Attorney, Agent, or Firm* — Muncy, Geissier, Olds & Lowe, P.C.

(57) ABSTRACT

A winding machine comprises an upright column, a winding machine base, a rotary mechanism, and a membrane frame. The bottom of the upright column housing main body and the winding machine base are connected by means of a first upright column cover plate and a second upright column cover plate to form a column shape. The upright column internally has a hoisting apparatus supporting frame. The lower end of the hoisting apparatus supporting frame is connected to the bottom inner side connecting piece. The upper end is connected to a top mounting rack of a hoisting apparatus. A lower portion mounting rack of the hoisting apparatus is connected to the bottom inner side connecting piece. A groove opening for ascending and descending movement is reserved on the upright column housing main body between the first upright column cover plate and the second upright column cover plate.

9 Claims, 8 Drawing Sheets

(58) Field of Classification Search
USPC ..... 53/587
See application file for complete search history.

(56) References Cited

U.S. PATENT DOCUMENTS

| | | | | |
|---|---|---|---|---|
| 6,318,048 | B1 * | 11/2001 | Sambuca, Jr. | B65B 7/20 493/475 |
| 6,871,566 | B2 * | 3/2005 | Niwayama | B67B 7/182 53/381.4 |
| 2003/0127553 | A1 * | 7/2003 | Marchetti | B65B 57/005 242/559.2 |
| 2008/0016821 | A1 * | 1/2008 | Huang | B65B 53/066 53/137.2 |
| 2008/0289298 | A1 * | 11/2008 | Casadei | B65B 11/045 53/211 |
| 2009/0293425 | A1 * | 12/2009 | Carter | B65B 11/025 53/167 |
| 2010/0064906 | A1 * | 3/2010 | Rossi | B65B 11/045 100/15 |
| 2010/0313525 | A1 * | 12/2010 | Martin | B65B 41/16 53/461 |
| 2011/0030317 | A1 * | 2/2011 | Murarotto | B65B 35/24 53/399 |
| 2012/0175170 | A1 * | 7/2012 | Martin | B65B 11/045 177/201 |

FOREIGN PATENT DOCUMENTS

| | | | | |
|---|---|---|---|---|
| CN | 201660133 | U | 12/2010 | |
| EP | 1092627 | A2 * | 10/1999 | B65B 11/045 |
| EP | 1092627 | A2 | 4/2001 | |
| EP | 1092627 | A3 | 7/2002 | |
| JP | 2001-171618 | A | 6/2001 | |
| WO | WO 2009/087600 | A2 | 7/2009 | |
| WO | WO 2009/087600 | A3 | 10/2009 | |

* cited by examiner

WINDING MACHINE

FIELD OF THE INVENTION

The present invention relates to a winding machine.

BACKGROUND OF THE INVENTION

The winding machine is a mechanical device used in the field of packaging machinery, which is used for wrapping packaging membrane on the surface of articles. The winding machine comprises an upright column, a turntable and a membrane frame. Articles are placed on the rotary mechanism which rotates with the rotary mechanism. The packaging film roll is mounted on the membrane frame, which is connected at the hoisting apparatus of the upright column for ascending and descending movement, and cut off by the membrane cutting element at the end of winding. The upright column is hollow, with the electrical control part of the winding machine. The winding machine is large, with special shape. The improvement goal of the wining machine is to achieve comprehensive improvement in transport, assembly and use, etc., for example, the relationship between the shape, volume and hollow of upright column. The operation convenience of site installation and the ease of transport is always a contradiction difficult to resolve. At present, most upright column housing adopts the welding way; although it can be assembled and welded in the factory, the upright column housing is a thin board, difficult to weld, and its shape is not nice after welding, nor disassembled as needed.

SUMMARY OF THE INVENTION

The technical problem to be resolved in the invention is to provide a winding machine, which is convenient to transport and can be connected without welding, facilitating to the assembly and commissioning in the site. To this end, the present invention adopts the following technical solutions:

A winding machine comprises an upright column, a winding machine base, a rotary mechanism and a membrane frame that can be lifted, wherein the upright column includes an upright column housing main body, and the bottom of which is connected with the winding machine base by a first upright column cover plate. The winding machine base is connected by means of a first upright column cover plate and a second upright column cover plate to form a column shape. The upright column is provided with an upright column bottom inner side connecting piece with an upright column outline shaping surface. The upright column outline shaping surface is connected with the upright column housing main body; the fixed connecting piece at the top is also connected with the upright column housing main body. The upright column is also internally provided with a hoisting apparatus supporting frame. The lower end of the hoisting apparatus supporting frame is connected to the bottom inner side connecting piece. The upper end is connected to a top mounting rack of a hoisting apparatus. A lower portion mounting rack of the hoisting apparatus is connected to the bottom inner side connecting piece. All of the components are connected by using bolts or screws. A groove opening for ascending and descending movement is reserved on the upright column housing main body between the first upright column cover plate and the second upright column cover plate.

On the basis of above technical solution, the invention also adopts the following further technical solution: the upright column housing main body, upright column bottom inner side connecting piece, top fixed connecting piece, hoisting apparatus supporting frame, top mounting rack, lower mounting rack and hoisting apparatus constitute the assembly of the upright column during transport, which is hinged with the winding machine base by the first connecting piece.

The upright column cover plate is processed to a concave-convex structure by rolled reinforcement.

Further, the upright column cover plate is bent in the width direction. The upright column cross-sectional profile is in a rectangle or rectangle with corner arc transition or with corner bevel; the upright column cover plate has three faces after bent, corresponding to three facades of the rectangle of upright column. The first facade part of the upright column corresponding to the first upright column cover plate and the second upright column cover plate is connected by said bolts or screws; a groove opening for ascending and descending movement is reserved between the first upright column cover plate and the second upright column cover plate on the third facade opposite to the first facade. The upright column is also provided with a lower connection piece, and the lower connection piece is provided with the connection part at both sides of groove opening corresponding to the first and second upright column cover plates at the bottom of the upright column and the connection part corresponding to the winding machine base, which are used for connecting the part of the first and second upright column cover plates at both sides of the groove opening and winding machine base with bolts or screws when erection and installation of upright column.

Furthermore, the end of the first facade corresponding to the first and second upright column cover plates is also folded inside the upright column, and spliced at the folding and connected by bolts or screws.

The top fixed connecting piece of the upright column in the invention may also have a downward folding, which is used to fix the column cross-sectional profile, and the upright column housing main body is connected to the folding.

The top fixed connecting piece of the upright column may form a part of the top cover of the upright column, and the top mounting rack of hoisting apparatus forms another part of the top cover of the upright column.

The present invention also provides a bottom outside connecting piece. At the bottom of the upright column facade adjacent to the first connecting piece, the connection part corresponding to the winding machine base and upright column body is provided, which is used to connect the winding machine base and upright column body, bottom inner side connecting piece by bolts or screws when erection and installation of upright column.

In the present invention, opposite to the groove opening for ascending and descending movement, the upright column is provided with a baffle board, and the bottom of which is connected with bottom inner side connecting piece by bolts or screws. The upper portion is plugged with the mounting rack at the top of the hoisting apparatus. A gap is reserved between the both sides of the baffle board and the upright column housing main body for the ascending and descending of parts.

The winding machine in the invention includes a transition piece located outside of winding machine upright column and a connecting piece located inside the upright column; the connecting piece is connected to the drive chain of the hoisting apparatus, the transition piece is connected to the connecting piece, and the membrane frame is detachably connected to the transition piece.

Further, the membrane frame is hung on the transition piece. Furthermore, the transition piece has the connection part for hanging the upper and lower membrane frames, and still furthermore, the transition piece and membrane frame are provided with the connection parts connected by screws or bolts.

The upright column is provided with guide rails for ascending and descending movement. The hoisting apparatus guide rail, hoisting apparatus supporting frame and the upright column housing main body are connected with bolts. The hoisting apparatus guide rail is located inside of the supporting frame of hoisting apparatus and fastened by bolts and nuts. The winding machine has a connecting piece, and the connecting piece is connected with the drive chain of the hoisting apparatus in the upright column, and guide part is provided at the connecting piece to match with the guide rail. The of the connecting piece is provided with a mounting groove facing outwards, and the mounting groove is provided with sliding block as the guide part, which can be adjusted front and back in the depth direction of the groove.

Further, the side surface of the connecting piece is provided with a mounting groove with the groove opening outwards, and the mounting groove is provided with sliding block as the guide part, which can be adjusted front and back in the depth direction of the groove.

Furthermore, the bottom of the mounting groove is connected with the adjusting screw, which holds out against the back of the sliding block, to adjust the sliding block front and back.

Still furthermore, the clearance fit is between the sliding block and the left and right walls of the mounting groove.

Still furthermore, the mounting groove is also provided with the limiting parts of the upper and lower position of the sliding block, which is located between the upper limiting part and the lower limiting part;

Still furthermore, the clearance fit is between the sliding block and the upper limiting part.

The winding machine base is provided with two beams, which is located on both sides of the winding machine upright column transversely, and the first beam located at the side of the upright column of lifting membrane frame is shorter which forms a notch corresponding to the lifting membrane frame, and the lower end of the lifting membrane frame can be descended to the notch. The end of the upright column set with the winding machine base is provided with a fork stretching port at two beams.

Further, the end of the beam mounted the winding machine base is in a flat, peripherally closed shape with the fork stretching port in the middle.

Furthermore, the beam uses the groove-shape steel as the main body, and the groove opening is downwards. Steel plate is welded at the groove opening and at the front end of the winding machine base, a fork stretching port is formed.

Still furthermore, the winding machine base has a connection structure between two beams, to make them a whole. The second beam among the two is extended to the side of the base of the upright column of the winding machine base, and the upright column base, the second beam and the connection structure at the front of the upright column base are welded.

The winding machine base is equipped with beams and bars. The beam and bar are provided with a jack at the welding place, which is used to position the connecting location of the beam and bar. The beam is welded with the bar and the bar has the insertion site matching with the jack.

Further, the insertion site on the bar matching with the jack is the protruding part at the front of the bar.

Furthermore, the cross section of the bar is in a groove shape and the protruding part is protruding at the end of the groove bottom. Further, one or more said jacks are provided at the welding point between the beam and each bar.

Still furthermore, the winding machine base is provided with two beams at the left and right, and on both sides of each beam is welded with bars respectively.

Still furthermore, the bars welded at two beams at the left and right are symmetric relative to the center line between two beams.

The winding machine base is provided with support structure of the winding machine rotary mechanism, and the support structure includes the roller that supports the rotary mechanism, and the base of the roller shaft is in groove shape vertically and the roller shaft is arranged at the top of the groove-shape base.

Further, the groove-shape base is made by grooved steel or made by bending of steel plate.

Furthermore, the roller shaft is non-rotatable shaft.

Still furthermore, the top of groove wall made by grooved steel is provided with a groove, and the roller shaft is propped in the groove.

Still furthermore, the base is mounted on the fixing member on the side of beam welded to the beam of the winding machine base.

Still furthermore, the support structure further comprises a multiple of support members distributed circumferentially on the concentric chain wheel that drives the rotary mechanism to rotate.

A transmission mechanism is arranged at the winding machine base, and the transmission mechanism comprises a coaxial drive sprocket and drive chain of the rotary mechanism. The transmission mechanism has the fixed tensioning wheel and movable tensioning wheel relative to the chain and the movable tensioning wheel is acting on the chain by the spring tension.

Further, the movable tension wheel is mounted on the pivotable mounting member, which is connected to the spring, and the spring is mounted on the fixing member. The mounting member may be a flat object.

Furthermore, the mounting member is provided with a long limiting groove or a pair of blocking members. The transmission mechanism is equipped with a fixed arresting pin which is inserted to the long limiting groove or between the pair of blocking members. The long limiting groove or arcuate groove uses the pivot point of the mounting member as the center of circle.

Still furthermore, the fixed tensioning wheel and movable tensioning wheel are located outside of two sides of the chain loop. Further, the positions of said tensioning wheel and movable tensioning wheel are basically symmetrical relative to the axis of said drive sprocket and driving sprocket of the chain.

The upright column in the invention has a proper structure and it main body structure can be assembled in a manufacturing factory by using the bolts or the screws and is hinged with the winding machine base, and accordingly, welding operations are avoided; and the winding machine has a nice appearance and is suitable to mount, commission and transport. The main body structure of the upright column forms a solid transport assembly, and the assembly can be rotated to fall flat and conveyed with the winding machine base. The assembly is rotated and lifted up to connect with the winding machine base, which is very convenient for transport and on-site installation.

Further, the upright column connects with the membrane frame by a transition piece. The membrane frame can be easily assembled without influencing the structure of the upright column. This structure makes the installation and commissioning of upright column can be completed in the manufacturing factory. During the transport, the membrane frame is removed, to ensure that the membrane frame is not damaged; and in the assembly site, just simply mount it, without other assembly and commissioning of the upright column structure, which can greatly reduce the workload and avoid the repeated work.

Furthermore, the lifting guide mechanism of the upright column in the invention has a simple structure, applicable for small upright column of winding machine, which can achieve lifting and descending by a single chain drive. Moreover, further, the guide mechanism can be adjusted back and forth, and achieve adaptive adjustment in the horizontal and vertical directions, lowering the matching requirements of the lifting guide mechanism for surrounding structures and achieving effective operation for a long time. In addition, the lifting guide mechanism of the present invention employs sliding block approach, which is easy to replace and install, with low costs.

Still furthermore, the lifting membrane frame of the winding machine base can lower to the notch during the operation of the winding machine, which can lower much than before, expand the operating range of the winding machine, and lower the minimum membrane-winding height; moreover, the present invention can be inserted from the rear end with a forklift, making it safer and more convenient.

Still furthermore, the winding machine base employs the jack positioning when welding the beam and bars, which can facilitate the positioning of the bar, simplify the welding process and reinforce the welding structure, improving the quality of welding.

The structure of the winding machine employing the technical solutions in the invention is compressively improved in the transport, assembly and use.

DETAILED DESCRIPTION OF THE EMBODIMENTS

Figure 2:
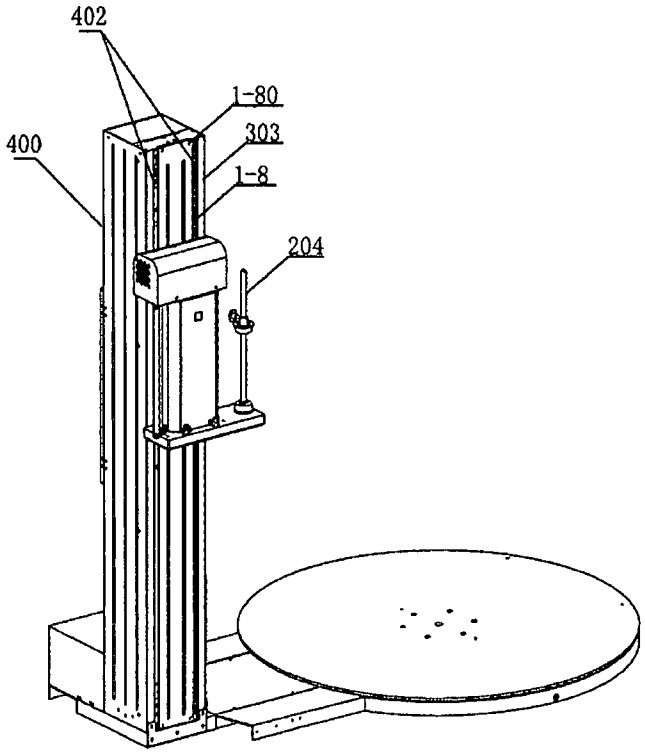
FIG. 2 is the overall scheme of the example in FIG. 1 in another direction.
Figure 1:
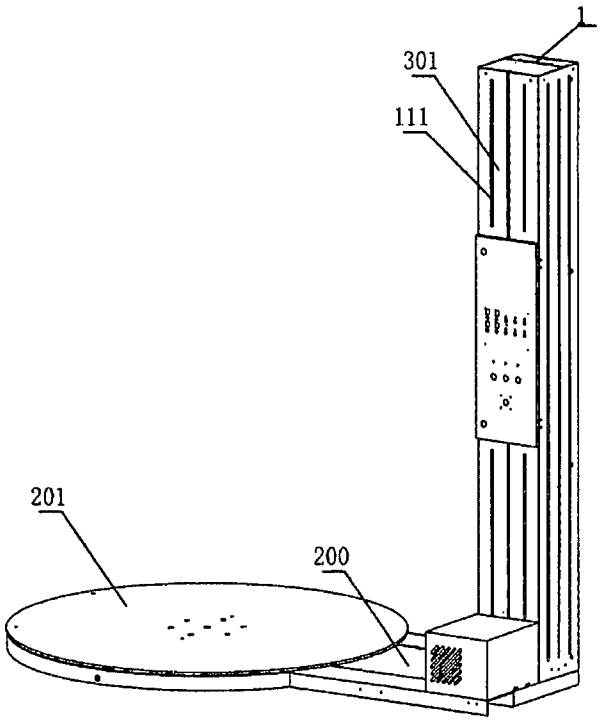
FIG. 1 is the overall scheme of an example of the winding machine in the invention.

Referring to the attached drawings, in particular FIGS. 1-4, the winding machine provided in the invention comprises an upright column 400, a winding machine base 200, a rotary mechanism 201 and an adjustable membrane frame 204. The rotary mechanism is used for carrying the membrane-wrapped articles.

The upright column 400 of the winding machine in the invention includes an upright column housing main body 1, and the bottom of which is hinged with the winding machine base 200 by means of a first connecting piece 100. The upright column housing main body 1 is formed in a column shape by means of the first upright column cover plate 1-11 and the second upright column cover plate 1-12 connected with each other. The upright column 400 of the winding machine is provided with an upright column bottom inner side connecting piece 1-2 which has an upright column outline shaping surface 1-20. The upright column 400 has a cross section formed in a rectangle, a rectangle with corner arcuate transition, or a rectangle with corner with bevel shape; accordingly, the upright column bottom inner side connecting piece 1-2 also has four upright column outline shaping surfaces 1-20 corresponding to the rectangle.

The top of the upright column 400 of the winding machine is provided with a top fixed connecting piece 1-3 which is connected to the upright column housing main body 1. The upright column 400 of the winding machine is also provided with the hoisting apparatus supporting frame 1-4, and the low end of which is connected to the bottom inner side connecting piece 1-2. The attached figure mark 1-22 is the connection part of the bottom inner side connecting piece 1-2 corresponding to the hoisting apparatus supporting frame 1-4. The upper end of the hoisting apparatus supporting frame 1-4 is connected to the top mounting rack 1-5 of the hoisting apparatus 20, and the lower mounting rack 1-51 of hoisting apparatus is connected to the bottom inner side connecting piece 1-2. The attached figure mark 1-21 is the connection part of bottom inner side connecting piece 1-2 corresponding to the lower mounting rack 1-51. All of above components are connected by using bolts or screws. A groove opening 112 for ascending and descending movement is reserved on the upright column housing main body 1 between the first upright column cover plate 1-11 and the second upright column cover plate 1-12.

The upright column housing main body 1, the upright column bottom inner side connecting piece 1-2, the top fixed connecting piece 1-3, the hoisting apparatus supporting frame 1-4, the top mounting rack 1-5, the lower mounting rack 1-51 and the hoisting apparatus 20 constitute the assembly of the upright column 400 during transport which is hinged with the winding machine base 200 by the first connecting piece 100. The hoisting apparatus 20 includes the drive chain 202 and its sprocket, drive motor 203 and its reduction mechanism, etc.

The upright column cover plates 1-11, 1-12 are processed to form a concave-convex structure by rolled reinforcement. By this way, a very thin sheet can guarantee the required rigidity. The upright column 400 is not easily deformed and it is convenient to mount and transport. In addition, the 3-D sense of the upright column 400 is enhanced, with a nice appearance. After rolled reinforcement, the surfaces of the upright column cover plates 1-11, 1-12 form the straight ribs 111, which can be the ones protruded from the outer surfaces towards the inner surfaces or the ones protruded from the inner surfaces towards the outer surfaces, and therefore making the upright column cover plates 1-11, 1-12 have a concave-convex structure. The rolled reinforcement treatment includes a variety of changes of patterns, which involve various shapes of ribs. The upright column cover plates 1-11, 1-12 can be drilled, grooved or cut notches according to needs, to reserve the positions for labeling, control panel and other purposes.

The upright column cover plates 1-11, 1-12 are bent in the width direction. The upright column cover plates 1-11, 1-12 have respectively three faces after bent, corresponding to three facades of the rectangle of the upright column 400. The first upright column cover plate 1-11 and the second upright column cover plate 1-12 are connected by said bolts or screws. The groove opening 112 for ascending and descending movement is reserved between the first upright column cover plate 1-11 and the second upright column cover plate 1-12 on the third facade 303 opposite to the first facade 301. The upright column 400 is also provided with a lower connection piece 1-9 at the bottom thereof, and the lower connection piece 1-9 is provided with the connection parts 1-91, 1-92 at both sides of the groove opening 112 corresponding to the first and second upright column cover plates 1-11, 1-12 and the connection part 1-93 corresponding to the winding machine base 200, which are used for connecting the parts of the first and second upright column cover plates 1-11, 1-12 at both sides of the groove opening 112 and the winding machine base 200 by bolts or screws when erection and installation of the upright column 400. The erection and installation is generally carried out during commissioning in the manufacturing factory or during the final installation in the production site.

The ends of the first upright column cover plate 1-11 and the second upright column cover plate 1-12 corresponding to the first facade are also folded inside to form the upright column folded edges 1-40 respectively which are spliced and connected by bolts or screws.

The top fixed connecting piece 1-3 of the upright column 400 in the invention may also have a downward folding 1-30, which is used to fix the cross-sectional profile of the upright column 400, and the upright column housing main body 1 is connected to the folding 1-30.

The top fixed connecting piece 1-3 of the upright column 400 may form a part of the top cover of the upright column 400, and the top mounting rack 1-5 of the hoisting apparatus 20 forms another part of the top cover of the upright column 400, which can protect the internal parts of the upright column 400, and at the same time, facilitate the manufacturing of the top fixed connecting piece 1-3 and the top mounting rack 1-5 according to needs.

The present invention also provides a bottom outside connecting piece 1-6 which is located at the bottom of the upright column facade adjacent to the first connecting piece 100, and has the connection parts 1-61, 1-62 corresponding to the winding machine base 200 and the upright column housing main body 1, which are used to connect the winding machine base 200, the upright column housing main body 1, and the bottom inner side connecting piece 1-2 by bolts or screws when erection and installation of the upright column 400.

Figures 3, 4:
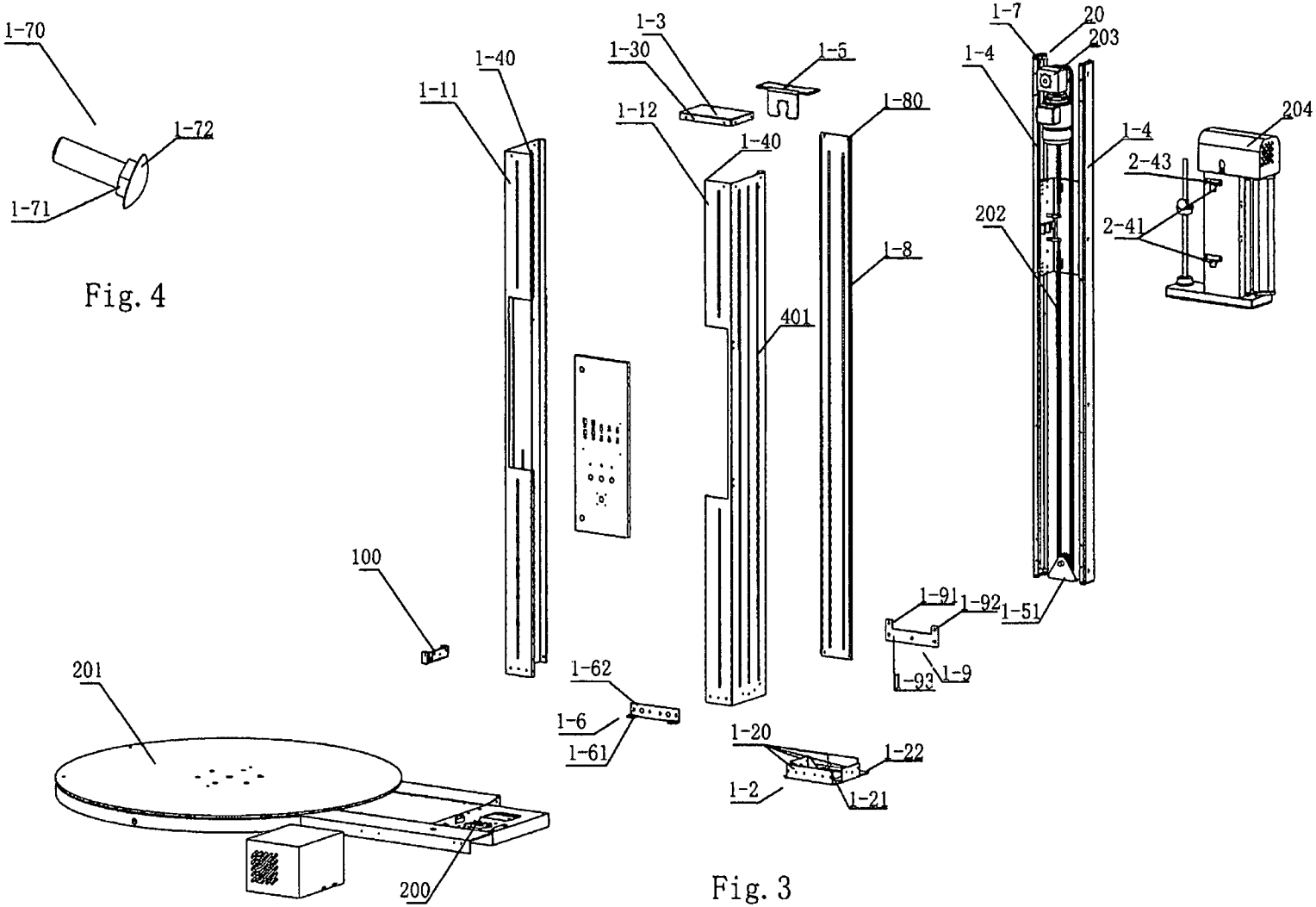
FIG. 3 is the exploded view of the upright column in the invention.
FIG. 4 is the schematic diagram of upright column cover plate, hoisting apparatus supporting frame and guide rail bolt in Example 3 in FIG. 3.

The present invention is also provided with a hoisting apparatus guide rail 1-7. The hoisting apparatus guide rail 1-7, the hoisting apparatus supporting frame 1-4 and the upright column housing main body 1 arc connected by bolts. The hoisting apparatus guide rail 1-7 is located inside the hoisting apparatus supporting frame 1-4 and fastened by bolts and nuts. The bolt 1-70 as shown in FIG. 4 can be employed. It has the middle level 1-71, which can pass through the bolt hole 401 of the first and second upright column cover plates 1-11, 1-12 to match the nuts to fasten the hoisting apparatus guide rail 1-7 and the hoisting apparatus supporting frame 1-4, so that the first and second upright column cover plates 1-11, 1-12 will not be fastened by the nut head 1-72 too tightly.

In the present invention, corresponding to the groove opening 112 for ascending and descending movement, the upright column 400 is provided with a baffle board 1-8, and the bottom of which is connected with the bottom inner side connecting piece 1-2 by bolts or screws. The upper portion of the baffle board 1-8 is plugged with the top mounting rack 1-5 of the hoisting apparatus 20. The attached figure mark 1-80 is its slot or long hole. Gaps 402 are reserved between the both sides of the baffle board 1-8 and the upright column housing main body 1 for the ascending and descending of parts. By this way, it can not only protect the parts inside the upright column 400, but also facilitate the disassembly and assembly of the baffle board 1-8, to maintain the interior of the upright column 400.

Figure 5:
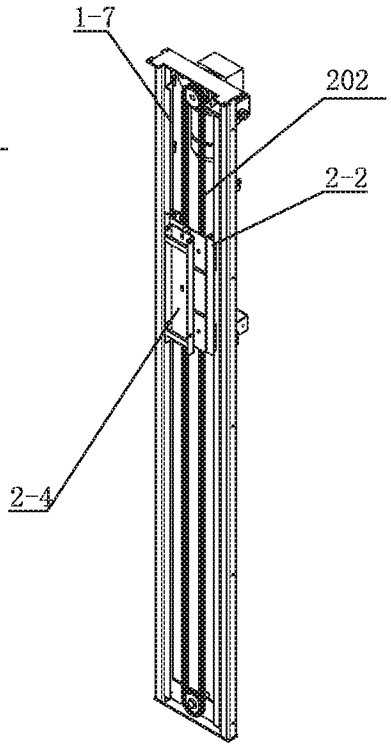
FIG. 5 shows an installation way of membrane frame and the schematic diagram of the lifting guide mechanism in the invention.
Figure 6:
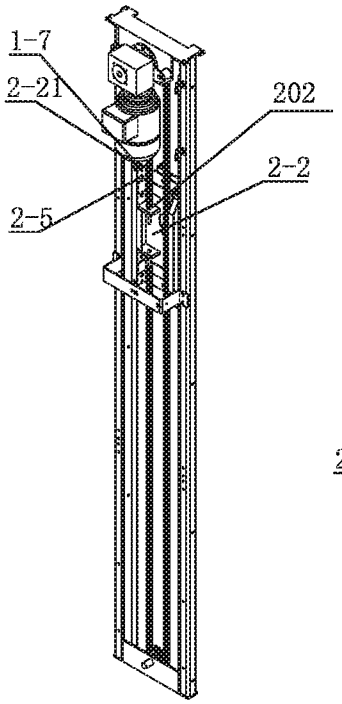
FIG. 6 is the schematic diagram of the mode of execution in another direction as shown in FIG. 5.
Figure 7:
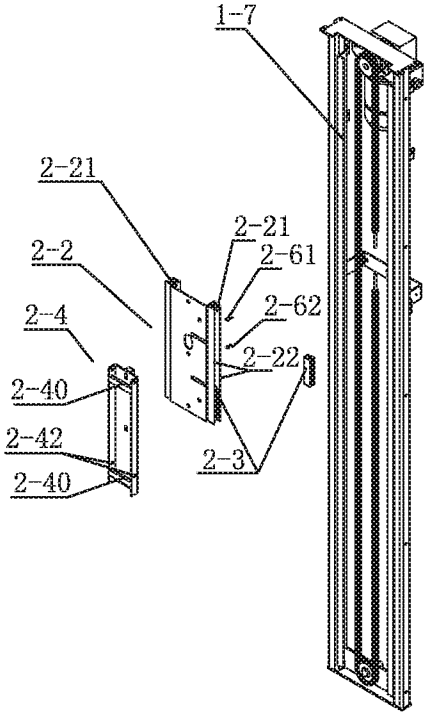
FIG. 7 is the exploded view of FIG. 5.

Referring to the attached figures and in particular FIGS. 5-7, the winding machine in the invention includes a transition piece 2-4 located outside the upright column 400 and a connecting piece 2-2 located inside the upright column 400. The connecting piece 2-2 is connected to the drive chain 202 of the hoisting apparatus 20, and is also connected to the transition piece 2-4. The membrane frame 204 is detachably connected to the transition piece 2-4.

The membrane frame 204 is hung on the transition piece 2-4. The transition piece has two connection parts 2-40 for hanging the upper and lower membrane frames, and the membrane frames have the corresponding hooks 2-41.

The transition piece 2-4 and the membrane frame 204 are also provided with the connection parts (2-42, 2-43) connected by screws or bolts.

The upright column 400 is provided with the guide rail 1-7 for ascending and descending movement. A sliding block 2-3 is provided on the connecting piece 2-2 to match with the guide rail 1-7.

The side of the connecting piece 2-2 is provided with a mounting groove 2-21 facing outwards, and the mounting groove 2-21 is provided with the sliding block 2-3, which can be adjusted front and back in the depth direction of the mounting groove 2-21.

For the adjustment way of sliding block 2-3, the Example employs a very simple, practical structure. The bottom of the mounting groove 2-21 is connected with the adjusting screw 2-5, which holds out against the back of the sliding block 2-3, to adjust the sliding block 2-3 front and back.

The sliding block 2-3 fits with the left and right walls 2-22 of the mounting groove 2-21, such that the adaptive control of the sliding block 2-3 can be adjusted left and right according to specific circumstances.

The mounting groove 2-21 is also provided with the limiting parts 2-61, 2-62 for the upper and lower positions of the sliding block 2-3, which means the sliding block 2-3 is located between the upper limiting part and the lower limiting part 2-61, 2-62. The sliding block 2-3 also fits with the upper limiting part 2-61, such that the adaptive control of the sliding block 2-3 can be adjusted up and down according to specific circumstances.

Figure 8:
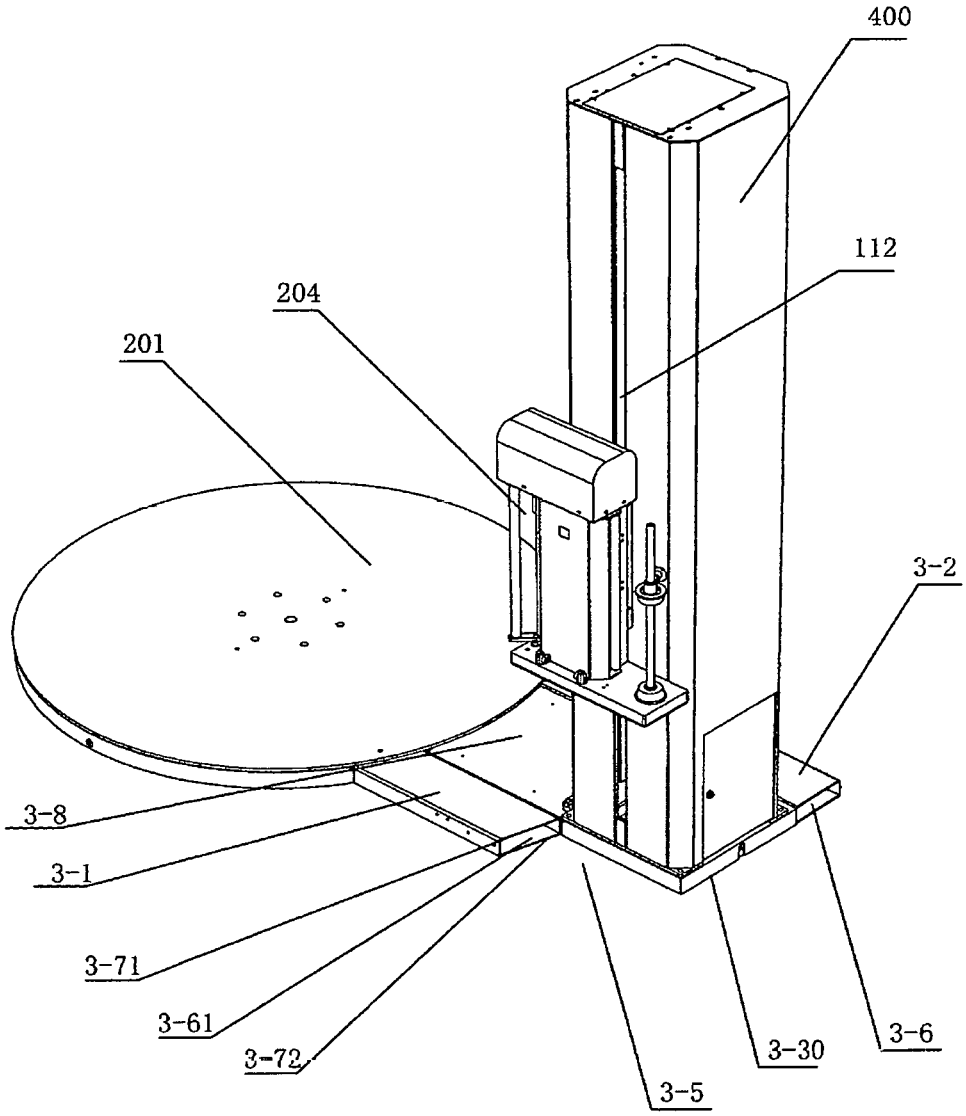
FIG. 8 is the overall schematic diagram of an example in the invention.
Figure 9:
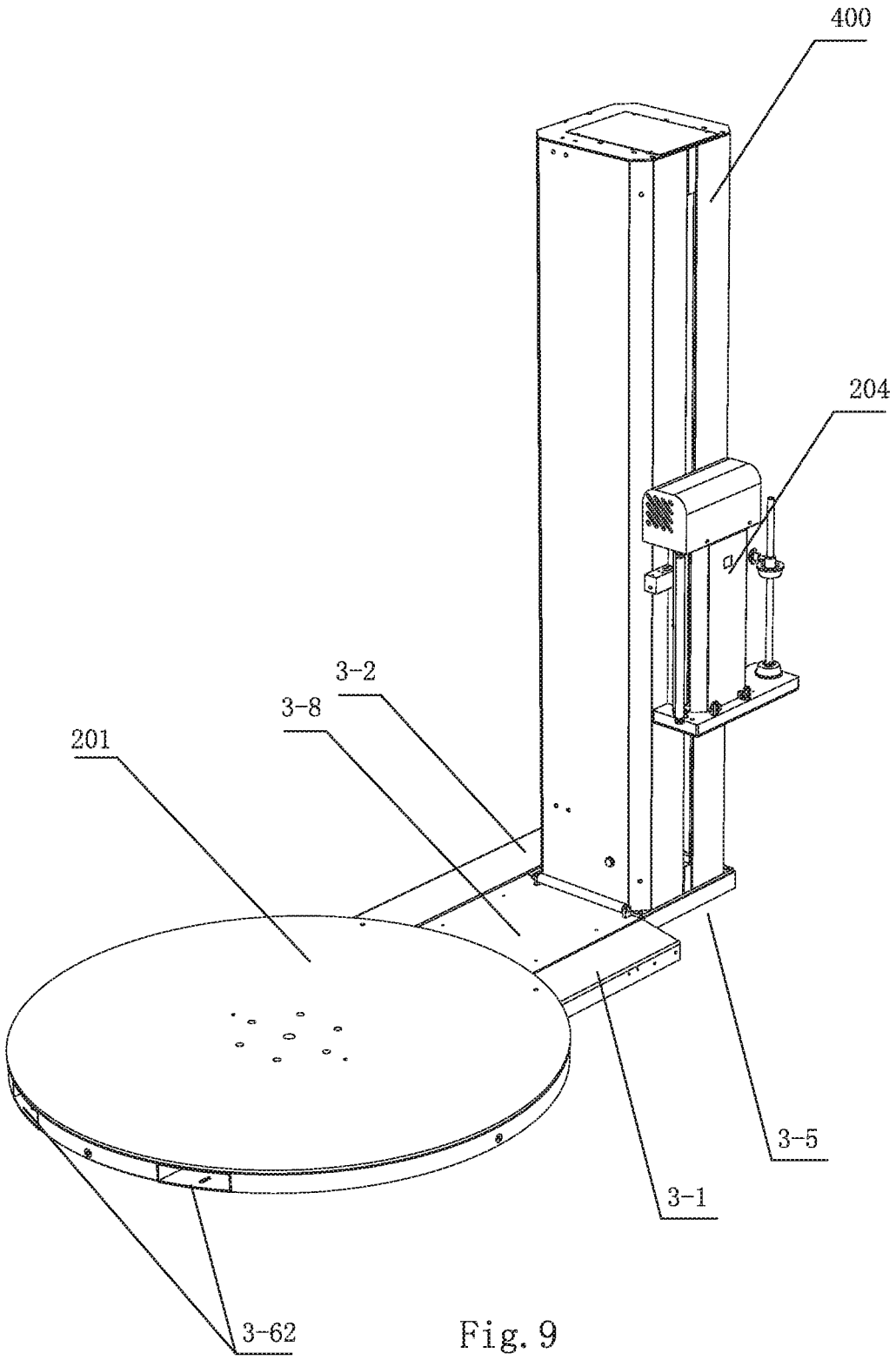
FIG. 9 is the schematic diagram of the example shown in FIG. 8 in another direction.

Referring to the attached figures, and in particular FIGS. 8,9. The winding machine base 200 in the present invention has two beams—the first beam 3-1 and the second beam 3-2. The first beam 3-1 and the second beam 3-2 are located at both sides of the upright column 400 transversely, and the first beam 3-1 located at the side of the upright column 400 where the membrane frame 204 is located is shorter which forms a notch 3-5 corresponding to the membrane frame 204, and thus the lower end of the membrane frame 204 can be descended to the notch 3-5 during operation.

The end of the winding machine base 200 where the upright column 400 is located is provided with a first fork stretching port 3-6 and a second fork stretching port 3-61 at the first and second beams 3-1, 3-2 respectively. During implementation, the first and second fork stretching ports 3-6, 3-61 can be formed directly by the first and second beams 3-1, 3-2, that is, the first and second beams 3-1, 3-2 located at the end of the winding machine base 200 where the upright column 400 is can be formed in a flat, peripherally closed shape with the first and second fork stretching ports 3-6, 3-61 in the middle.

The first and second beams 3-1, 3-2 also can use the groove-shape steel 3-71 as the main body, and the opening of the groove-shape steel 3-71 is downwards and is welded with a steel plate 3-72, and at the front end of the winding machine base 200, a third fork stretching port 3-62 is formed.

The winding machine base 200 has a connection structure 3-8 between two beams 3-1, 3-2, to make them as a whole. The second beam 3-2 is extended to the side of the upright column base 3-30 of the winding machine base 200, and the upright column base 3-30, the second beam 3-2 and the connection structure 3-8 at the front of the upright column base 3-30 are welded.

Figures 10, 11:
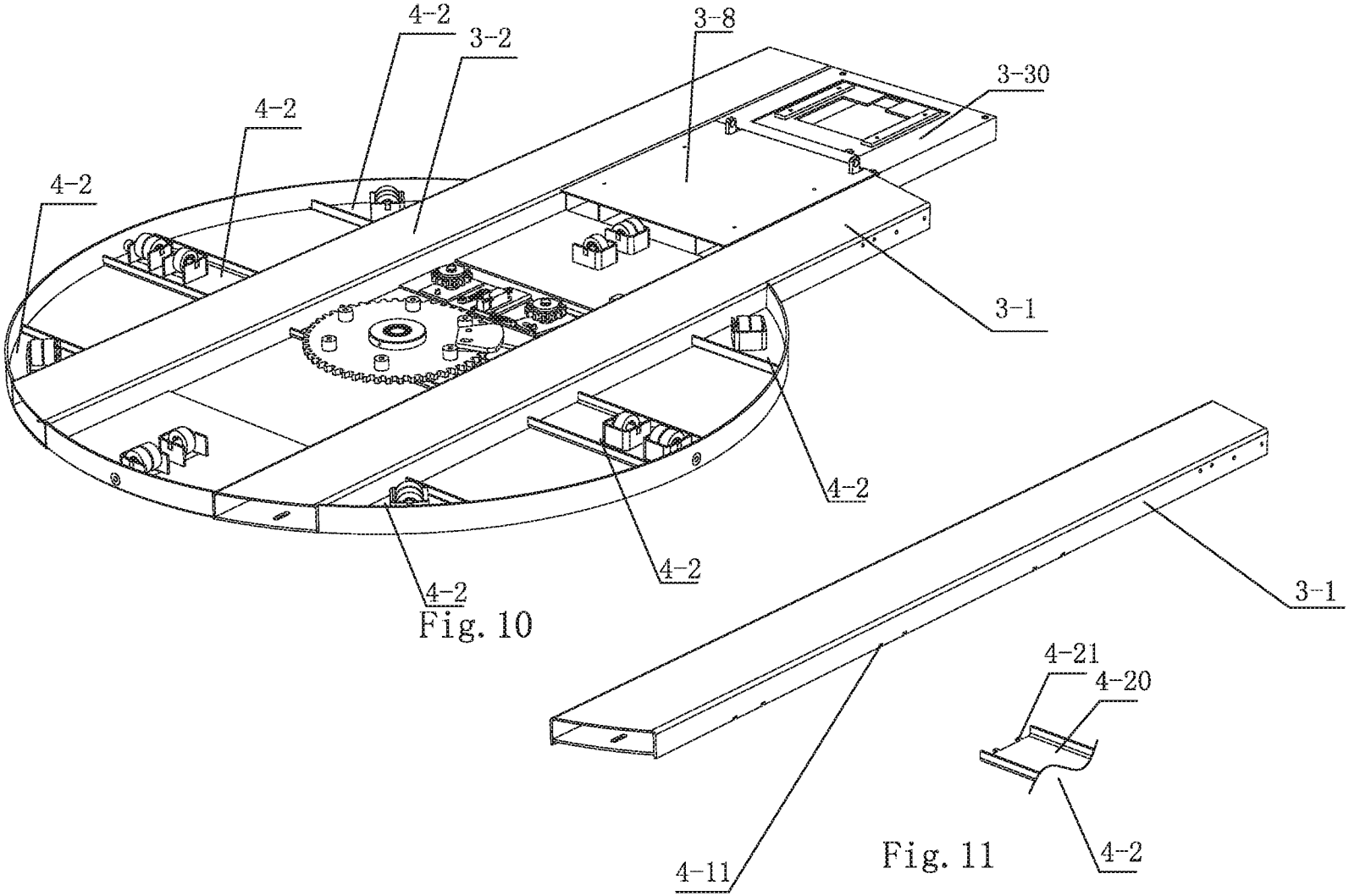
FIG. 10 is the schematic diagram of the example of winding machine base provided in the invention.
FIG. 11 is the exploded diagram of beam and bar in FIG. 10.

Referring to the figures, in particular FIGS. 10 and 11, the mode of execution in the present invention also provides a welding structure of the winding machine base. The welding adopts the jack positioning, which facilitates the positioning of the bar and simplifies the welding process, and reinforces the welding structure, improving the welding quality.

The winding machine base is equipped with beam 3-1, beam 3-2 and bar 4-2. The beam 3-1, beam 3-2 and bar 4-2 are provided with a jack 4-11, which is used to position the beam 3-1, beam 3-2 and bar 4-2. The beam 3-1, beam 3-2 are welded with the bar 4-2 and the bar 4-2 has an insertion site 4-21 matching with the jack 4-11.

The insertion site 4-21 on the bar matching with the jack is the protruding part at the front of the bar.

The cross section of the bar 4-2 is in a groove shape and the protruding part is protruding at the end of the groove bottom 4-20.

One or more said jacks are provided at the welding points between the beam 3-1, beam 3-2 and each bar 4-2.

As shown in the figures, the winding machine base is provided with two beams at the left and right, which are the first beam 3-1 and the second beam 3-2, and on both sides of each beam is welded with bars, respectively. The bars welded at two beams at the left and right are symmetric relative to the center line between two beams.

Figure 12:
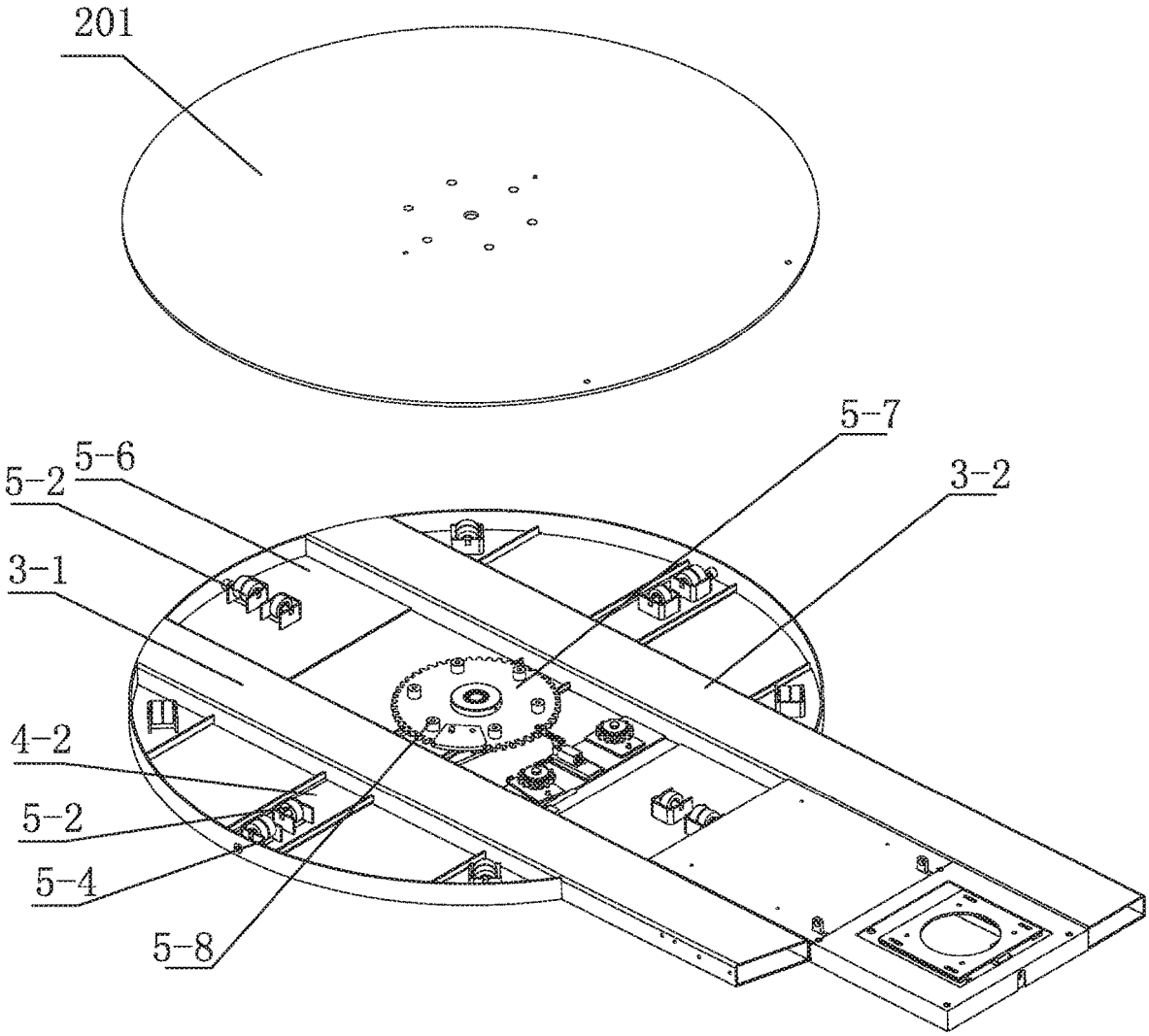
FIG. 12 is the exploded view of winding machine base and rotary mechanism in the example provided in the invention.
Figure 13:
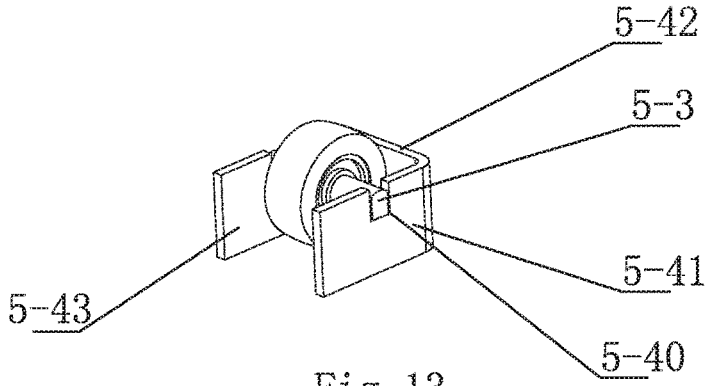
FIG. 13 is the combined schematic diagram of roller and its groove-shape base in FIG. 12.

Referring to the figures, in particular FIGS. 12 and 13, the mode of execution of the present invention also provides a support structure of the winding machine rotary mechanism. The structure is simple and the cost is low.

The present invention includes a roller 5-2 that supports the rotary mechanism 201. The base 5-4 of the roller shaft 5-3 is in an upright groove shape. The roller shaft 5-3 is arranged at the top of the groove-shape base 5-4. When the groove-shape structure is arranged upright, its bottom part plays a role of connection for two upright groove walls in the entire height range of the base, to prevent them from deformation, so that the whole support structure is firm and the rotary mechanism is supported in a stable and balanced manner. The upright placement is as shown in FIG. 13, the groove opening 5-43 is facing the side and the ends of the groove is the upper and lower ends instead of the left and right ends.

The groove-shape base 5-4 is made by grooved steel or made by bending of steel plate.

The top of groove wall 5-41 made by grooved steel is provided with a groove 5-40, and the roller shaft 5-3 is propped in the groove 5-40. The attached figure mark 5-42 is a part of the groove bottom of the groove-shape base 5-4.

The roller shaft 5-3 is non-rotatable shaft, for example, the square shaft fitting with the base 5-4.

The base 5-4 is mounted on the fixing member on the side of beam welded to the beam 3-1 and the beam 3-2 of the winding machine base, for example, the fixing member 5-6 on bar 4-2 between the beam 3-1 and the beam 3-2.

The support structure further comprises a multiple of support members 5-8 distributed circumferentially on the concentric chain wheel 5-7 that drives the rotary mechanism to rotate.

Figure 14:
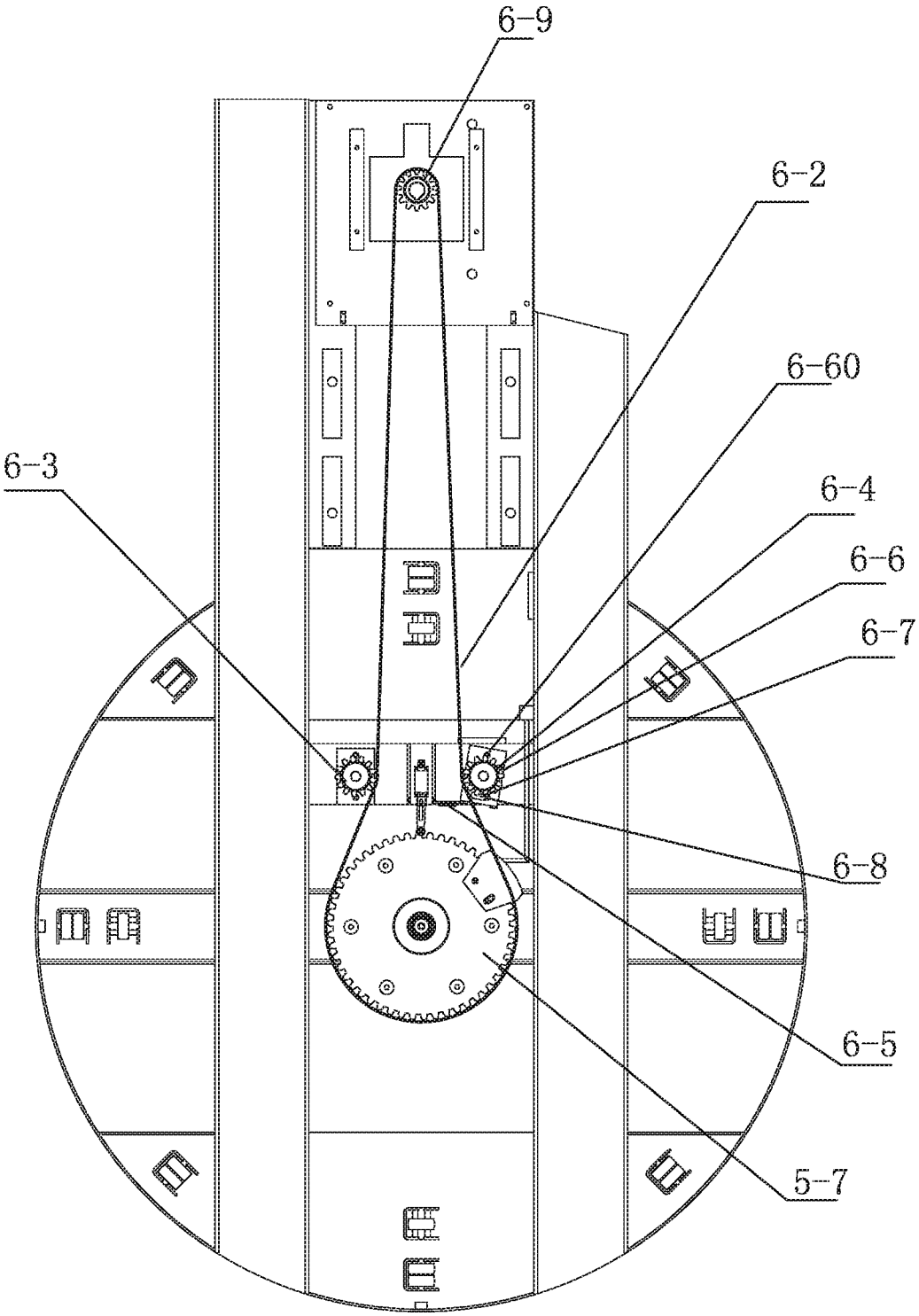
FIG. 14 is the top view of transmission mechanism of rotary mechanism in the example provided in the invention.

Referring to the attached figures, in particular FIG. 14, in the mode of execution in the present invention, a transmission mechanism of rotary mechanism is provided, which has tensioning effect for the chain with stable tension state, moreover, the tension of the chain can be automatically adjusted according to the actual situations, so that the rotary mechanism can smoothly rotate, enhancing the membrane-wrapping effect.

The transmission mechanism 201 comprises a coaxial drive sprocket 5-7 and a drive chain 6-2 of the rotary mechanism. The transmission mechanism has a fixed tensioning wheel 6-3 and movable tensioning wheel 6-4 relative to the chain and the movable tensioning wheel is acting on the chain 6-2 by the tension of spring 6-5. The rotary mechanism 201 can be the turntable that connects to the shaft of drive sprocket.

The movable tension wheel 6-4 is mounted on the pivotable mounting member 6-6, which is connected to the spring 6-5, and the spring 6-5 is mounted on the fixing member such as the winding machine base. The mounting member 6-6 is a flat object.

Further, the transmission mechanism may also be provided with position limiting mechanism of the movable tensioning wheel. The mounting member 6-6 is provided with an arcuate groove 6-7 that plays a limiting role. The arcuate groove 6-7 uses the pivot point 6-60 of the mounting member 6-6 as the center of circle. The transmission mechanism is also provided with a fixed arresting pin 6-8, which can be mounted on the winding machine base, and the arresting pin 6-8 is inserted in the arcuate groove 6-7.

The fixed tensioning wheel 6-3 and movable tensioning wheel 6-4 are located outside of two sides of the chain loop.

The positions of said tensioning wheel 6-3 and movable tensioning wheel 6-4 are basically symmetrical relative to the axis of said drive sprocket 5-7 and driving sprocket 6-9 of the chain, that is, it is preferred that the midpoint of movable tensioning wheel is symmetrical to the fixed tensioning wheel 6-3. The driving sprocket 6-9 rotates driven by a motor.

What is claimed is:

1. A winding machine comprising an upright column, a winding machine base, a rotary mechanism and a membrane frame that can be lifted, wherein the upright column includes an upright column housing main body, and a bottom of which is connected with the winding machine base, a first upright column cover plate and a second upright column cover plate are connected to each other to form the upright column housing main body in a column shape, the upright column housing main body includes a first facade having a control panel, the upright column is provided with an upright column bottom inner side connecting piece with an upright column outline shaping surface;

the upright column outline shaping surface is connected with the bottom of the upright column housing main body;

the upright column is provided with a fixed connecting piece is connected with a top of the upright column housing main body;

the upright column is also internally provided with a hoisting apparatus supporting frame and a hoisting apparatus guide rail for ascending and descending movement, a lower end of the hoisting apparatus supporting frame is connected to the bottom inner side connecting piece, an upper end of the hoisting apparatus supporting frame is connected to a top mounting rack of a hoisting apparatus, and the hoisting apparatus guide rail is located at an inside surface of the hoisting apparatus supporting frame;

a lower mounting rack of the hoisting apparatus is connected to the bottom inner side connecting piece, all of the components are connected by using bolts or screws, a groove opening for ascending and descending movement is reserved between the first upright column cover plate and the second upright column cover plate on a third facade of the upright column housing main body, which is opposite to the first facade, wherein the upright column connects with the membrane frame via a transition piece for allowing the membrane frame to be lifted, the transition piece located outside the upright column and a connecting piece located inside the upright column are provided; the hoisting apparatus includes a drive motor and a drive chain mounted on the drive motor and having two ends, the connecting piece includes an upper portion and a lower portion, the upper portion and the lower portion of the connecting piece are respectively connected with the two ends of the drive chain of the hoisting apparatus, the transition piece is connected to the connecting piece, and the membrane frame is detachably connected to the transition piece; one side of the connecting piece is provided with a mounting groove facing outwards, and a sliding block is located in the mounting groove to match the hoisting apparatus guide rail, which can be adjusted front and back in the depth direction of the mounting groove.

2. The winding machine according to claim 1, wherein the upright column cross-sectional profile is in a rectangle or rectangle with corner arc transition or with corner bevel; the first upright column cover plate and the second upright column cover plate respectively have three faces after bent; the first upright column cover plate and the second upright column cover plate is connected to each other by said bolts or screws; the upright column is also provided with a lower connection piece, and the lower connection piece is provided with the connection part at both sides of the groove opening corresponding to the first and second upright column cover plates at the bottom of the upright column and the connection part corresponding to the winding machine base, which are used for connecting the part of the first and second upright column cover plates at both sides of the groove opening and winding machine base with the bolts or screws when erection and installation of upright column.

3. The winding machine according to claim 2, wherein the ends of the first and second upright column cover plates, which are corresponding to the first facade, are also folded inside the upright column, and spliced at the folding and connected by the bolts or screws.

4. The winding machine according to claim 1, wherein the upright column is provided with a baffle board corresponding to the groove opening for ascending and descending movement, and the bottom of the baffle board is connected with the bottom inner side connecting piece by the bolts or screws, and the upper portion of the baffle board is plugged with the top mounting rack of the hoisting apparatus, a gap is reserved between both sides of the baffle board and the upright column housing main body for ascending and descending.

5. The winding machine according to claim 1, wherein the hoisting apparatus guide rail, the hoisting apparatus supporting frame and the upright column housing main body are connected with bolts, the hoisting apparatus guide rail and the hoisting apparatus supporting frame are fastened by bolts and nuts.

6. The winding machine according to claim 5, wherein the sliding block fits with left and right walls of the mounting groove; the mounting groove is also provided with an upper limiting part and a lower limiting part of the sliding block, the sliding block is located between the upper limiting part and the lower limiting part; and the sliding block fits with the upper limiting part.

7. The winding machine according to claim 5, wherein the winding machine base is provided with a first beam and a second beam, which are located at both sides of the upright column transversely, and the first beam located at the side of the upright column where the membrane frame is located is shorter which forms a notch corresponding to the membrane frame, and the lower end of the membrane frame can be descended to the notch, the end of the winding machine base where the upright column is located is provided with a first fork stretching port and a second fork stretching port at the first and second beams respectively.

8. The winding machine according to claim 1, wherein the winding machine base is equipped with beams and bars, the beams and bars are provided with a jack, which is used to position the beams and bars, the beam is welded with the bars and the bars have the insertion site matching with the jack.

9. The winding machine according to claim 1, wherein the winding machine base is provided with support structure of the winding machine rotary mechanism, and the support structure includes a roller that supports the rotary mechanism, and the base of a roller shaft is in groove shape vertically and the roller shaft is arranged at the top of the groove-shape base.

* * * * *